US005821684A

United States Patent [19]

Murai et al.

[11] Patent Number: 5,821,684

[45] Date of Patent: Oct. 13, 1998

[54] COLOR CATHODE RAY TUBE WITH SUPPRESSED DOMING

[75] Inventors: Takashi Murai, Fukaya; Masatsugu Inoue, Kumagaya; Nobuhiko Akoh, Gumma-ken; Kumio Fukuda, Fukuya, all of Japan

[73] Assignee: Kabushiki Kaisha Toshiba, Kawasaki, Japan

[21] Appl. No.: 695,761

[22] Filed: Aug. 8, 1996

Related U.S. Application Data

[63] Continuation of Ser. No. 420,777, Apr. 12, 1995, abandoned.

[30] Foreign Application Priority Data

Apr. 12, 1994 [JP] Japan ..... 6-072998
Oct. 20, 1994 [JP] Japan ..... 6-255203

[51] Int. Cl.[6] ..... H01J 29/07

[52] U.S. Cl. ..... 313/402; 313/403; 313/408

[58] Field of Search ..... 313/402, 403, 313/407, 408

[56] References Cited

U.S. PATENT DOCUMENTS

| | | | |
|---|---|---|---|
| 3,947,718 | 3/1976 | van Lent | 313/408 |
| 4,210,842 | 7/1980 | Nakayama et al. | 313/403 |
| 4,370,591 | 1/1983 | Satoh | 313/402 |
| 4,475,056 | 10/1984 | Hirai | 313/402 X |
| 4,583,022 | 4/1986 | Masterton | 313/402 X |
| 4,631,441 | 12/1986 | Morrell et al. . | |
| 4,636,683 | 1/1987 | Tokita et al. | 313/403 |
| 4,665,339 | 5/1987 | Masterton et al. | 313/403 |
| 4,691,138 | 9/1987 | Masterton . | |
| 5,055,736 | 10/1991 | Yun et al. | 313/402 |
| 5,534,746 | 7/1996 | Marks et al. | 313/402 X |
| 5,663,558 | 9/1997 | Watanabe et al. | 313/408 X |

FOREIGN PATENT DOCUMENTS 56-73845 6/1981 Japan .

*Primary Examiner*—Sandra L. O'Shea
*Assistant Examiner*—Mack Haynes
*Attorney, Agent, or Firm*—Cushman Darby & Cushman Intellectual Property Group of Pillsbury Madison & Sutro LLP

[57] ABSTRACT

A color cathode ray tube has a substantially rectangular shadow mask in which a plurality of slit type aperture arrays are aligned in the direction of the major axis of an effective region defined by a curved surface opposing a phosphor screen formed on the inner surface, defined by a concave curved surface, of the effective region of a panel. Each slit type aperture array is obtained by arranging a plurality of slit type apertures in an array in the direction of the minor axis of the effective region of the shadow mask. In this color cathode ray tube, the difference between the array interval of the slit type aperture arrays at a peripheral portion on the long side of the shadow mask and the array interval of the slit type aperture arrays on the major axis is a maximum value within a distance range of 0.4 h to 0.9 h (h is ½ the length of the effective region of the shadow mask in the direction of the major axis) from the minor axis, and the array interval of the slit type aperture arrays at the end of the major axis is larger than that of the slit type aperture arrays at a corner. Thus, local doming of the shadow mask can be suppressed.

3 Claims, 2 Drawing Sheets

COLOR CATHODE RAY TUBE WITH SUPPRESSED DOMING

This is a continuation of application Ser. No. 08/420,777, filed on Apr. 12, 1995, which was abandoned upon the filing hereof Ser. No. 08/695,761.

BACKGROUND OF THE INVENTION

1. Field of the Invention

The present invention relates to a color cathode ray tube and, more particularly, to a color cathode ray tube in which local doming of its shadow mask is suppressed.

2. Description of the Related Art

Generally, in a color cathode ray tube, a shadow mask is arranged to oppose a phosphor screen comprising phosphor layers of three different colors formed on the inner surface of a panel. The phosphor screen is scanned with three electron beams emitted from an electron gun assembly through the shadow mask, thereby displaying a color image. In order to increase the color purity of the color image formed on the phosphor screen, the three electron beams emitted from the electron gun assembly must be selected by the shadow mask so that they correctly land on the corresponding phosphor layers of the three colors. For this purpose, the phosphor screen and the shadow mask must maintain a predetermined relationship with each other, i.e., the q value representing the gap between the shadow mask and the phosphor screen must always fall within a predetermined range.

Generally, however, in a shadow mask type color cathode ray tube, of the electron beams emitted from the electron gun assembly, only ⅓ or less electron beams reach the phosphor screen, and other electron beams not reaching the phosphor screen collide against the shadow mask. Therefore, the shadow mask is heated by collision of the electron beams and expands to bulge toward the phosphor screen, causing so-called doming.

Doming is classified into doming in which, after an operation of a comparatively long period of time, the shadow mask body and the frame thermally expand at the same time to bulge from the central axis of the color cathode ray tube in the horizontal direction, and local doming in which the mask body locally thermally expands to bulge toward the screen within a comparatively short period of time. When the positional change of the shadow mask caused by doming exceeds the allowable range of the q value, the electron beams land on the phosphor layers of the three colors with an error, thus degrading the color purity. Landing errors of the electron beams caused by doming largely differ depending on the position and luminance of the image pattern on the screen and the duration of the image pattern.

FIG. 1 shows local doming which occurs when a high-luminance image is locally displayed on the screen. Assume that a shadow mask 1 is supported by a phosphor screen 6 formed on the inner surface of a panel 2 through engagement of stud pins 3 provided to the panel 2 and elastic support members 5 mounted on a mask frame 4, to be located at a position indicated by a solid line with a predetermined gap from the phosphor screen 6. Even if an electron beam 7 having a low current density for displaying a low-luminance image collides against the shadow mask 1, the shadow mask 1 does not substantially cause a positional change, and the electron beam 7 passing through one aperture 8 located at a position A correctly lands on a corresponding phosphor layer 9. However, when an electron beam 7 having a high current density for locally displaying a high-luminance image collides against the shadow mask 1, the shadow mask 1 is locally heated and expands as indicated by an alternate long and short dash line. As a result, the aperture 8 is shifted from the position A to a position B, and the electron beam 7 does not correctly land on the corresponding phosphor layer 9 any longer, thus causing color misregistration.

As described above, when a high-luminance image is locally displayed on the screen, local mislanding occurs due to local thermal expansion of the shadow mask caused by collision of an electron beam having a high current density for displaying the high-luminance image, and this local mislanding tends to occur more likely at a portion closer to the two ends of the horizontal axis of the screen than in the central portion of the screen, especially in intermediate portions between the central portion of the screen and the two ends of the horizontal axis. This local mislanding caused by local thermal expansion of the shadow mask tends to occur more likely in a shadow mask having a larger radius of curvature. Accordingly, to decrease mislanding caused by local thermal expansion of the shadow mask in order to prevent color misregistration, the radius of curvature of the shadow mask is preferably decreased. For this purpose, in conventional color cathode ray tubes in which the phosphor layers of three colors constituting a phosphor screen are formed as stripes elongated in the vertical direction, and a shadow mask is arranged to oppose this phosphor screen to have a plurality of slit type aperture arrays, each obtained by arranging a plurality of slit type apertures in an array in the vertical direction, aligned in the horizontal direction, a color cathode ray tube as follows is known. In this color cathode ray tube, the horizontal interval of the stripes of phosphor layers of three colors is sequentially increased from the center of the phosphor screen in the horizontal direction, and accordingly the horizontal interval of the slit type aperture arrays of the shadow mask is also sequentially increased from the center of the shadow mask in the horizontal direction, so that the radius of curvature of the section of the shadow mask in the horizontal direction is decreased, thereby suppressing mislanding caused by local thermal expansion of the shadow mask.

Recently, however, a color cathode ray tube having a flat panel is becoming the mainstream. In the color cathode ray tube having a flat panel, the curved surface of the shadow mask is also entirely flat. Therefore, if the radius of curvature of the section of the shadow mask is decreased only in the horizontal direction, as in the shadow mask described above, it is difficult to suppress doming caused by thermal expansion, especially local doming occurring within a comparatively short period of time, and to thereby eliminate mislanding.

SUMMARY OF THE INVENTION

It is an object of the present invention to provide a color cathode ray tube in which doming caused by thermal expansion of the shadow mask, particularly local doming occurring between the center and the two ends of the major axis of the shadow mask, is effectively suppressed.

According to the present invention, there is provided a color cathode ray tube having a phosphor screen formed on the inner surface, defined by a concave curved surface, of the effective region of a substantially rectangular panel, and a substantially rectangular shadow mask opposing the phosphor screen and having an effective region defined by a curved surface. In this shadow mask, a plurality of slit type aperture arrays, each obtained by arranging a plurality of slit type apertures in an array in the vertical direction of its effective region, aligned in the horizontal direction. The interval of slit type apertures is a distance measured from the mid-point of one aperture to that of the adjacent aperture along the horizontal axis. In this color cathode ray tube, the difference $d(k)=P_{L(k)}-P_{C(k)}$ between the array interval $P_{L(k)}$ of the slit type aperture arrays at a peripheral portion on the long side of the shadow mask and the array interval $P_{C(k)}$ of the slit type aperture arrays on the major (horizontal) axis has a maximum value within a range of 0.4 h to 0.9 h from the minor (vertical) axis to the major axis, where h is ½ the length of the effective region of the shadow mask in the direction of the major axis, and the array interval of the slit type aperture arrays at the two ends of the major axis is larger than that at the corners.

Regarding the array interval of the slit type aperture arrays, the array interval of the slit type aperture arrays at the two ends of the minor axis is set to be substantially equal to that at the central portion.

With the above arrangement, even in, e.g., a color cathode ray tube having a flat panel providing an apparently natural image, the gap between the inner surface of the panel and the shadow mask can be made relatively larger larger at intermediate portions along the long side than at intermediate portions along the major axis, so that the radius of curvature of the section of the shadow mask at intermediate portions between the center and the two ends of the major axis of the shadow mask can be decreased in the direction of the minor axis. As a result, local doming that tends to occur at intermediate portions between the center and the two ends of the major axis of the shadow mask can be suppressed, thereby decreasing mislanding.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

A color cathode ray tube according to a preferred embodiment of the present invention will be described with reference to the accompanying drawings.

Figure 1:
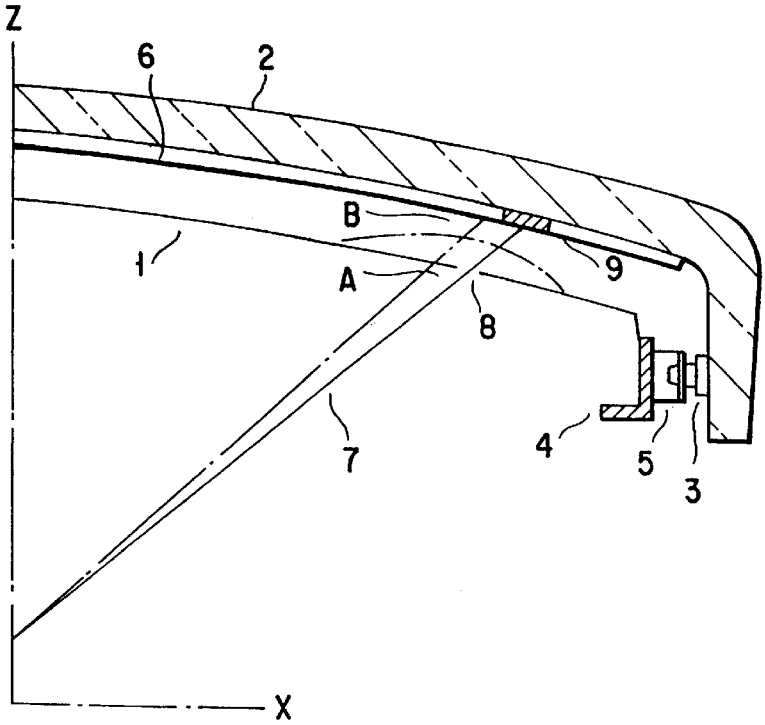
FIG. 1 PRIOR ART
FIG. 1 is a view for explaining mislanding caused by doming of a shadow mask.
Figure 2:
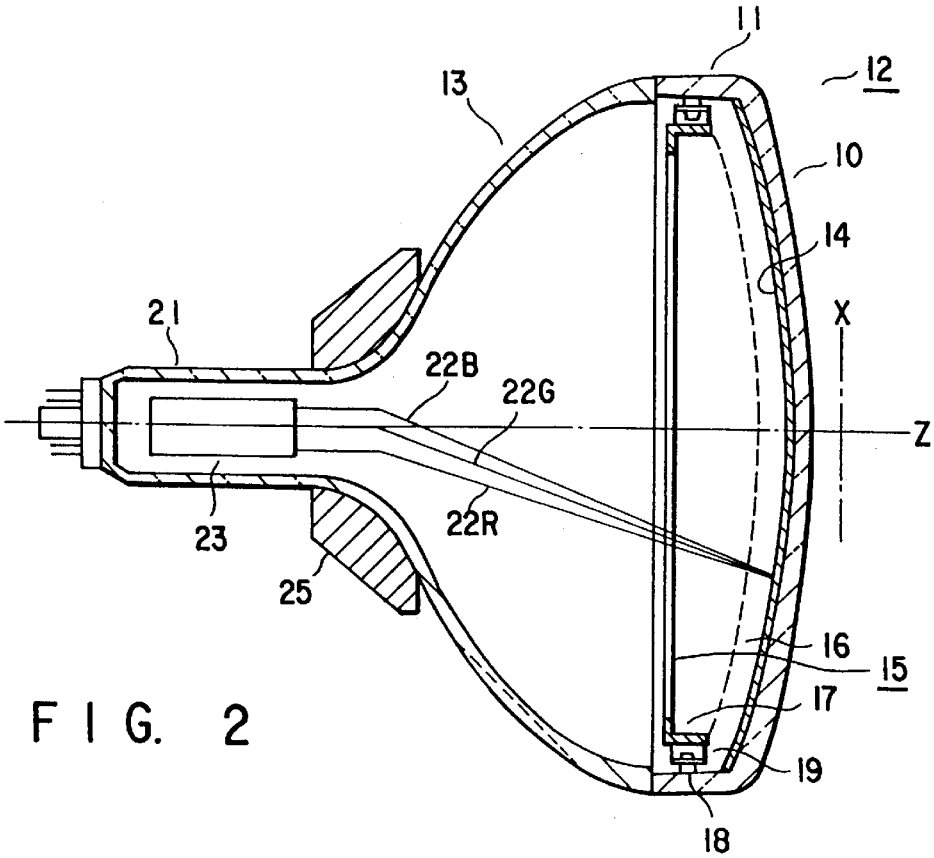
FIG. 2 is a view showing the arrangement of a color cathode ray tube according to an embodiment of the present invention.

FIG. 2 shows a color cathode ray tube according to an embodiment of the present invention. This color cathode ray tube has an envelope comprising a substantially rectangular panel 12 and a funnel 13. The panel 12 has a skirt portion 11 extending from the peripheral portion of an effective region 10 defined by a curved surface. The funnel 13 is bonded to the skirt portion 11. The inner surface of the effective region 10 of the panel 12 forms an aspherical concave curved surface. A phosphor screen 14, obtained by aligning stripes of three-color phosphor layers, each emitting blue, green, or red, elongated in the vertical direction, i.e., in the direction of the minor axis, and arranged in the horizontal direction corresponding to the X-axis, i.e., in the direction of the major axis, is provided on the inner surface of the effective region 10. A shadow mask 15 is arranged to oppose the phosphor screen 14. The shadow mask 15 is substantially rectangular and consists of a mask body 16 and a mask frame 17. The mask body 16 has an effective region defined by a curved surface in which a large number of slit type apertures are formed, as will be described later. The mask frame 17 is mounted on the peripheral portion of the mask body 16. The mask body 16 is supported inside the panel 12 with stud pins 18 provided to the skirt portion 11 of the panel 12 and elastic support members 19 mounted on the mask frame 17 to engage with the stud pins 18, so that its effective region opposes the phosphor screen 14 through a predetermined gap. An electron gun assembly 23 for emitting an array of three electron beams 22B, 22G, and 22R traveling on the same horizontal plane is disposed in a neck 21 of the funnel 13.

Figure 3:
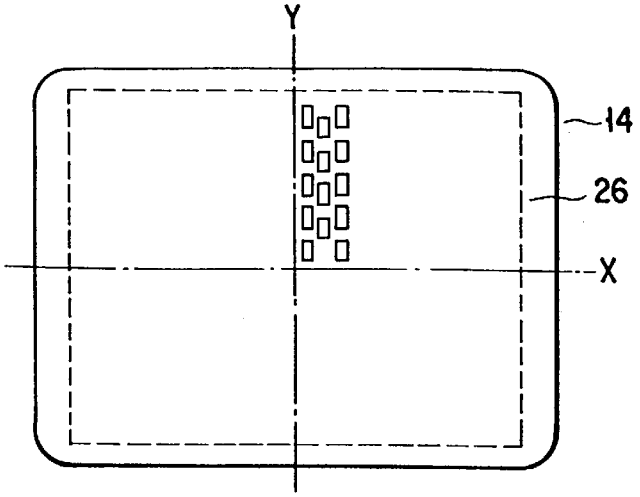
FIG. 3 is a view showing a region on a phosphor screen shown in FIG. 2 where a color image is formed.

The three electron beams 22B, 22G, and 22R emitted from the electron gun assembly 23 are deflected by the magnetic field generated by a deflecting unit 25 mounted on the outer side of the funnel 13, and scan the phosphor screen 14 horizontally and vertically through the apertures of the shadow mask 15, thereby displaying a color image on a rectangular region 26 shown in FIG. 3.

Figure 4:
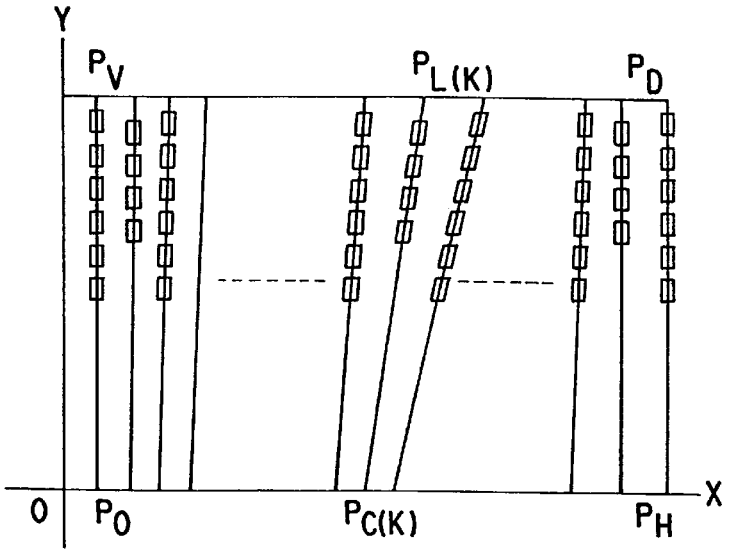
FIG. 4 is a graph showing the interval of the slit type aperture arrays on the horizontal axis and that on the end of the vertical axis in the horizontal direction of the shadow mask.

Regarding the slit type apertures of the shadow mask 15, a plurality of slit type apertures, elongated in the vertical direction, are arranged in an array to extend in the vertical direction through a bridge and are aligned in the horizontal direction, so as to correspond to the stripes of three-color phosphor layers of the phosphor screen 14. The interval of slit type apertures is a distance measured from the mid-point of one aperture to that of the adjacent aperture along the horizontal axis. Regarding the alignment of the slit type aperture arrays in the horizontal direction, as shown in FIG. 4, assume that the interval of the slit type aperture arrays at the center (X=0, Y=0) of the shadow mask 15 is $P_O$, that the interval of the slit type aperture arrays at an end of the horizontal axis, i.e., at an end of the X axis is $P_H$, that the interval of the slit type aperture arrays at an end of the vertical axis, i.e., at an end of the Y axis is $P_V$, that the interval of the slit type aperture arrays at an end of a diagonal axis (at a corner) is $P_D$, that ½ the number of slit type aperture arrays in the horizontal direction is n, that the interval between the (k−1)th and (k)th slit type aperture arrays on the horizontal axis that changes from $P_O$ to $P_H$ is $P_{C(k)}$, and that the interval between the (K−1)th and (k)th slit type aperture arrays at an end of the vertical axis in the horizontal direction that changes from PV to PD (a peripheral portion on the long side) is $P_{L(k)}$. More specifically, assume that the interval of the slit type aperture arrays on the horizontal axis changes from the center of the shadow mask 15 in the direction of the horizontal axis as:

$$P_O \ldots P_{C(k)} \ldots P_H$$

and that the interval of the slit type aperture arrays at an end of the vertical axis in the horizontal direction, i.e., at a portion on the long side, changes from the end of the vertical axis toward the end of the diagonal axis as:

$$P_V \ldots P_{L(k)} \ldots P_D$$

In order to decrease the radius of curvature of the section of the mask body in the horizontal direction, the interval $P_{C(k)}$ of the slit type aperture arrays on the horizontal axis is set by equation 1 as follows with a constant A:

$$P_{C(k)} = P_o + A \left\{ \sum_{i=1}^{k} P_{C(i-1)} \right\}^2 . \quad (1)$$

Figure 5:
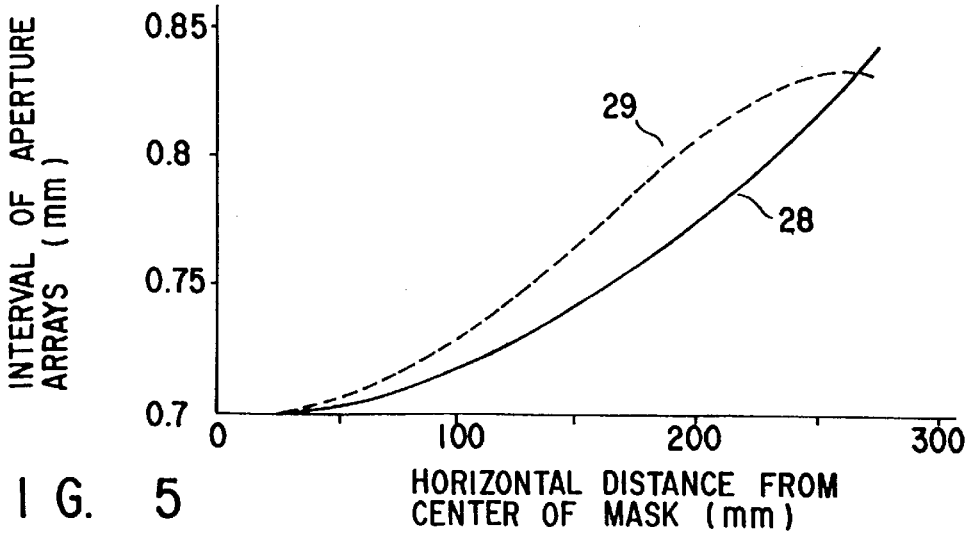
FIG. 5 is a graph showing a change in array interval of the slit type aperture arrays in the direction of the major axis of the shadow mask of the color cathode ray tube according to the embodiment of the present invention.

An example of the change in interval $P_{C(k)}$ of the slit type aperture arrays on the horizontal axis which is set by equation 1 is indicated by a curve 28 in FIG. 5. In contrast to this interval $P_{C(k)}$ of the slit type aperture arrays on the horizontal axis, the interval $P_{L(k)}$ of the slit type aperture arrays at the end of the vertical axis in the horizontal direction, as indicated by a curve 29 in FIG. 5, is set by equation 2 as follows with a constant Bm:

$$P_{L(k)} = P_o + \sum_{m=1}^{3} \left[ B_m \left\{ \sum_{i=1}^{k} P_{L(i-1)} \right\}^{2m} \right] \quad (2)$$

Then, when the constant $B_m$ is appropriately selected, at an intermediate portion in the horizontal direction, the interval $P_{L(k)}$ of the slit type aperture arrays at the end of the vertical axis in the horizontal direction is larger than the interval $P_{C(k)}$ of the slit type aperture arrays on the horizontal axis to satisfy:

$$P_{L(k)} > P_{C(k)}$$

and the difference d(k) between them satisfying:

$$d(k) = P_{L(k)} - P_{C(k)}$$

can maximized between the center and the end of the horizontal axis of the shadow mask, i.e., at an intermediate portion on the horizontal axis. In this case, the intervals $P_H$ and $P_D$ of the slit type aperture arrays at the end of the horizontal axis on the short side and at the end of the diagonal axis, i.e., at the corner, respectively, satisfy:

$$P_L < P_C$$

that is, $$P_D < P_H$$

and, on the vertical axis, they satisfy:

$$P_L = P_C$$

that is, $$P_V = P_O$$

As a practical example of this shadow mask, a shadow mask for a 28-inch color cathode ray tube will be described.

In this shadow mask, the interval of the slit type aperture arrays at the central portion of the shadow mask $P_O$=0.70 mm the interval of the slit type aperture arrays at the end of the horizontal axis $P_H$=0.84 mm the interval of the slit type aperture arrays at the end of the vertical axis $P_V$=0.70 mm the interval of the slit type aperture arrays at the end of the diagonal axis $P_D$=0.83 mm The intervals change in accordance with values on the X and Y axes, i.e., the horizontal and vertical distances. A, B1, $B_2$, $B_3$ are examples of coefficients which are appropriately selected from among a plurality of coefficients. The variations of $P_{C(k)}$ and $P_{L(k)}$ depend on the values of A, $B_1$, $B_2$ and $B_3$.

$A=1.903\times10^{-6}$ $B1=3.200\times10^{-6}$ $B2=-1.040\times10^{-11}$ $B3=-1.160\times10^{-16}$ Then, the radius of curvature of the section of the shadow mask in the vertical direction can be set to 1,570 mm at a position 200 mm from the center of the shadow mask toward the end of the horizontal axis, which is smaller than that of 1,730 mm of a conventional shadow mask.

Therefore, when the shadow mask is formed as described above, local doming conventionally occurring at intermediate portions on the horizontal axis, i.e., local doming occurring within a distance range of 0.4 h to 0.9 h from the vertical axis, where h is ½ the length of the effective region of the shadow mask in the horizontal axis, can be suppressed, thereby decreasing local mislanding. As a result, a degradation in color purity can be greatly reduced. When this shadow mask is applied to a color cathode ray tube having a flat panel, especially a color cathode ray tube that can display an image naturally, a large improvement can be obtained.

When the radius of curvature of the shadow mask is decreased, as described above, the mechanical strength is improved, and a deformation of the shadow mask caused by impact or vibration can be prevented, so that a degradation in color reproducibility caused by deformation can be prevented. Furthermore, the curved surface of the shadow mask can be formed with high precision, thereby decreasing the occurrence of a defective product in the shadow mask manufacturing process.

The color cathode ray tube described above has a substantially rectangular shadow mask with an effective region defined by a curved surface opposing a phosphor screen which is formed on the inner surface, defined by a concave curved surface, of the effective region of a substantially rectangular panel. In this shadow mask, a plurality of slit type aperture arrays, elongated in the vertical direction, are arranged in the vertical direction and are aligned in the horizontal direction In the color cathode ray tube described above, when the difference $d(k)=P_{L(k)}-P_{C(k)}$ between the array interval $P_{L(k)}$ of the slit type aperture arrays at a peripheral portion on the long side of the shadow mask and the array interval $P_{C(k)}$ of the slit type aperture arrays on the major axis has a maximum value within a distance range of 0.4 h to 0.9 h from the minor axis in the direction of the major axis, where h is ½ the length of the effective region of the shadow mask in the direction of the major axis, the array interval of the slit type aperture arrays at the two ends of the major axis is larger than the array interval of the slit type aperture arrays at the corners, and the array interval of the slit type aperture arrays at the two ends of the minor axis is formed to be substantially equal to that at the central portion, then the radius of curvature of the section of the shadow mask in the direction of the minor axis can be decreased between the center and the two ends of the major axis of the shadow mask while maintaining a small radius of curvature of the section of the shadow mask in the direction of the major axis. Therefore, local doming conventionally occurring at intermediate portions on the major axis can be suppressed to decrease local mislanding, so that a degradation in color purity can be greatly reduced. When this shadow mask is applied to a color cathode ray tube having a flat panel, especially a color cathode ray tube that can display an image naturally, a large improvement can be obtained. The mechanical strength of the shadow mask is improved, and a deformation of the shadow mask caused by an impact or vibration can be prevented, so that a degradation in color reproducibility caused by deformation can be prevented. Furthermore, the curved surface of the shadow mask can be formed with high precision, thereby decreasing the occurrence of a defective product in the shadow mask manufacturing process.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A color cathode ray tube comprising:

an envelope including a substantially rectangular panel having an inner surface defined by a concave curved surface, a funnel connected to said panel, and a neck extending from said funnel;

a phorphor screen formed on an effective region of said inner surface of said panel; and a shadow mask which is substantially rectangular, has long and short sides, and being fixed in said panel, said shadow mask having an effective region defined by a curved surface opposing said phosphor screen, said effective region having a minor axis and a major axis and a plurality of slit type aperture arrays, said plurality of slit type aperture arrays being obtained by arranging a plurality of slit type apertures in an array in a direction of said minor axis of said effective region, and said slit type apertures being aligned in a direction of said major axis, wherein a difference $d(k)=P_{L(k)}-P_{C(k)}$ between an array interval $P_{L(k)}$ of said plurality of slit type aperture arrays at a peripheral portion on said long side of said shadow mask and an array interval $P_{C(k)}$ of said plurality of slit type aperture arrays on said major axis is changed along said major axis and has a maximum positive value within a range of 0.4 h to 0.9 h from said minor axis, where h is ½ a length of said effective region of said shadow mask in said direction of said major axis, and an array interval of said plurality of slit type aperture arrays at an end of the major axis is formed to be larger than an array interval of said plurality of slit type aperture arrays at a corner;

said array interval $P_{C(k)}$ is defined by an equation $$P_{C(k)} = P_O + A\left\{\sum_{i=1}^{k} P_{C(i-1)}\right\}^2,$$

where $P_O$ is an array interval on a center of said shadow mask on said major axis, and A is a positive number; and said array interval $P_{L(k)}$ is defined by an equation $$P_{L(k)} = P_O + \sum_{m=1}^{3}\left[B_m\left\{\sum_{i=1}^{k} P_{L(i-1)}\right\}^{2m}\right],$$

where $B_1$, $B_2$ and $B_3$ are real numbers appropriately selected such that, at an intermediate portion in said direction of said major axis, said array interval $P_{L(k)}$ is greater than said array interval $P_{C(k)}$.

2. A color cathode ray tube according to claim 1, wherein an array interval of said plurality of slit type aperture arrays at an end of the minor axis is substantially equal to an array interval of said plurality of slit type aperture arrays at said center of said shadow mask.

3. A color cathode ray tube according to claim 1, wherein an array interval $P_D$ at an end of said major axis on said long side of said peripheral portion of said shadow mask is less than an array interval $P_H$ on said end of said major axis.

* * * * *